US010316490B2

(12) United States Patent
Lee

(10) Patent No.: US 10,316,490 B2
(45) **Date of Patent: *Jun. 11, 2019**

(54) CONTROLLING A CROWD PARAMETER OF AN INDUSTRIAL MACHINE

(71) Applicant: Harnischfeger Technologies, Inc., Wilmington, DE (US)

(72) Inventor: Mooyoung Lee, Milwaukee, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 48 days.

This patent is subject to a terminal disclaimer.

(21) Appl. No.: 15/611,472

(22) Filed: Jun. 1, 2017

(65) Prior Publication Data

US 2017/0268199 A1 Sep. 21, 2017

Related U.S. Application Data

(63) Continuation of application No. 14/987,548, filed on Jan. 4, 2016, now Pat. No. 9,689,141, which is a (Continued)

(51) Int. Cl.
*E02F 3/00* (2006.01)
*E02F 3/30* (2006.01)

(Continued)

(52) U.S. Cl.
CPC ..... *E02F 3/435* (2013.01); *E02F 3/30* (2013.01); *E02F 3/304* (2013.01); *E02F 3/425* (2013.01);

(Continued)

(58) Field of Classification Search
CPC ..... E02F 3/00; E02F 3/30; E02F 3/304; E02F 3/425; E02F 3/435; E02F 3/46; E02F 9/00; E02F 9/2016; E02F 9/265
See application file for complete search history.

(56) References Cited

U.S. PATENT DOCUMENTS 2,858,070 A 10/1958 Scharff
3,638,211 A 1/1972 Sanchez (Continued)

FOREIGN PATENT DOCUMENTS

AU 5826586 8/1987
CN 201199679 Y 2/2009

(Continued)

OTHER PUBLICATIONS

Office Action from the Chinese State Intellectual Property Office of the People's Republic of China for Application No. 2015101089854 dated Feb. 14, 2018 (6 pages including Statement of Relevance).

(Continued)

*Primary Examiner* — Yonel Beaulieu
(74) *Attorney, Agent, or Firm* — Michael Best & Friedrich LLP

(57) ABSTRACT

A controller that includes a memory and an electronic processor. The electronic processor receives a first signal and a second signal. The electronic processor determines a retract torque limit based on the first signal and the second signal. The electronic processor sets a retract torque parameter of a crowd motor to the retract torque limit that has been determined. The electronic processor operates the crowd motor at or below the retract torque parameter.

20 Claims, 9 Drawing Sheets

Related U.S. Application Data continuation of application No. 14/601,716, filed on Jan. 21, 2015, now Pat. No. 9,260,834.

(60) Provisional application No. 61/929,646, filed on Jan. 21, 2014.

(51) Int. Cl.

| | |
|---|---|
| ***E02F 3/46*** | (2006.01) |
| ***E02F 9/00*** | (2006.01) |
| ***E02F 3/43*** | (2006.01) |
| ***E02F 9/20*** | (2006.01) |
| ***E02F 9/26*** | (2006.01) |
| ***E02F 3/42*** | (2006.01) |

(52) U.S. Cl.

CPC ..... *E02F 3/46* (2013.01); *E02F 9/2016* (2013.01); *E02F 9/265* (2013.01)

(56) References Cited

U.S. PATENT DOCUMENTS

| | | | |
|---|---|---|---|
| 3,740,534 | A | 6/1973 | Kezer et al. |
| 3,965,407 | A | 6/1976 | Stoner |
| 3,976,211 | A | 8/1976 | Baron et al. |
| 4,046,270 | A | 9/1977 | Baron et al. |
| 4,263,535 | A | 4/1981 | Jones |
| 4,278,393 | A | 7/1981 | Baron |
| 4,308,489 | A | 12/1981 | Bergmann |
| 4,509,895 | A | 4/1985 | Baron |
| 4,677,579 | A | 6/1987 | Radomilovich |
| 4,776,751 | A | 10/1988 | Saele |
| 5,019,761 | A | 5/1991 | Kraft |
| 5,408,767 | A | 4/1995 | Hazama et al. |
| 5,469,647 | A | 11/1995 | Profio |
| 5,499,463 | A | 3/1996 | Profio et al. |
| 5,918,527 | A | 7/1999 | Haga et al. |
| 5,968,103 | A | 10/1999 | Rocke |
| 5,996,703 | A | 12/1999 | Yamamoto et al. |
| 6,025,686 | A | 2/2000 | Wickert et al. |
| 6,225,574 | B1 | 5/2001 | Chang et al. |
| 6,321,153 | B1 | 11/2001 | Rocke et al. |
| 6,466,850 | B1 | 10/2002 | Hilgart |
| 6,480,773 | B1 | 11/2002 | Hilgart |
| 7,174,826 | B2 | 2/2007 | Kerrigan et al. |
| 7,378,950 | B2 | 5/2008 | Lehnen |
| 7,832,126 | B2 | 11/2010 | Koellner et al. |
| 7,853,384 | B2 | 12/2010 | Johnson et al. |
| 8,260,834 | B2 | 9/2012 | Gouget et al. |
| 8,340,822 | B2 | 12/2012 | Nagasaka |
| 8,355,847 | B2 | 1/2013 | Colwell et al. |
| 8,359,143 | B2 | 1/2013 | Colwell et al. |
| 8,463,508 | B2 | 6/2013 | Nicholson et al. |
| 8,560,183 | B2 | 10/2013 | Colwell et al. |
| 8,571,766 | B2 | 10/2013 | Colwell |
| 8,620,536 | B2 | 12/2013 | Colwell et al. |
| 8,935,061 | B2 | 1/2015 | Colwell |
| 9,260,834 | B2 | 2/2016 | Lee |
| 9,567,725 | B2 * | 2/2017 | Taylor ..... E02F 3/437 |
| 9,745,721 | B2 * | 8/2017 | Linstroth ..... E02F 3/435 |
| 2007/0168100 | A1 | 7/2007 | Danko |
| 2007/0266601 | A1 | 11/2007 | Claxton |
| 2008/0154466 | A1 | 6/2008 | Shenoy et al. |
| 2009/0018718 | A1 | 1/2009 | Lang et al. |
| 2009/0319133 | A1 | 12/2009 | Ekvall et al. |
| 2010/0036645 | A1 | 2/2010 | McAree |
| 2010/0063682 | A1 | 3/2010 | Akaki |
| 2011/0029206 | A1 | 2/2011 | Kang et al. |
| 2011/0029279 | A1 | 2/2011 | McAree et al. |
| 2011/0088290 | A1 | 4/2011 | Rowlands |
| 2011/0146114 | A1 | 6/2011 | Hren et al. |
| 2011/0282626 | A1 | 11/2011 | Rikkola |
| 2011/0282630 | A1 | 11/2011 | Rikkola |
| 2012/0092180 | A1 | 4/2012 | Rikkola |
| 2012/0187754 | A1 | 7/2012 | Emerson |
| 2012/0275893 | A1 | 11/2012 | Colwell et al. |
| 2012/0308354 | A1 | 12/2012 | Tafazoli Bilandi et al. |
| 2013/0051963 | A1 | 2/2013 | Taylor |
| 2013/0138305 | A1 | 5/2013 | Colwell et al. |
| 2013/0142605 | A1 | 6/2013 | Colwell et al. |
| 2014/0082975 | A1 | 3/2014 | Fischer et al. |
| 2014/0236432 | A1 | 8/2014 | Haisler |
| 2015/0089847 | A1 | 4/2015 | Gross et al. |
| 2015/0204052 | A1 | 7/2015 | Lee |

FOREIGN PATENT DOCUMENTS

| | | |
|---|---|---|
| CN | 103003801 A | 3/2013 |
| WO | WO2009121122 | 10/2009 |

OTHER PUBLICATIONS

Chilean Office Action for Application No. PCT2015000136 dated Aug. 25, 2017 (8 pages Statement of Relevance Included).

Examination Report issued from the Australian Patent Office for related Application No. 2015200234 dated Aug. 6, 2018 (3 pages).

* cited by examiner

CONTROLLING A CROWD PARAMETER OF AN INDUSTRIAL MACHINE

RELATED APPLICATIONS

This application is a continuation of U.S. patent application Ser. No. 14/987,548, filed Jan. 4, 2016, now U.S. Pat. No. 9,689,141, which is a continuation of U.S. patent application Ser. No. 14/601,716, filed Jan. 21, 2015, now U.S. Pat. No. 9,260,834, which claims the benefit of U.S. Patent Application No. 61/929,646, filed Jan. 21, 2014, the entire content of which is hereby incorporated by reference.

BACKGROUND

This invention relates to controlling a crowd parameter of an industrial machine, such as an electric rope or power shovel.

SUMMARY

Industrial machines, such as electric rope or power shovels, draglines, etc., are used to execute digging operations to remove material from, for example, a bank of a mine. When designing such industrial machines, one factor that is limiting to the design is the increase in structural loading experience by the machine as a result of greater machine weight, larger payloads, and larger component size. As such, as industrial machines are made larger, the structural loading that the industrial machine experiences increases. The structural loading on the industrial machine can result in forward and rearward tipping moments about an axis of the industrial machine, damage to components of the industrial machine, decreased performance, etc.

For example, the structural loading experienced by the industrial machine becomes a maximum when the shovel is at the end of a digging operation because a shovel attachment (e.g., dipper) and the digging materials within the shovel attachment are suspended at the furthest location away from the industrial machine. The structural loading experienced by the industrial machine is also influenced by the transition from the end of a digging cycle to the start of a swing cycle in which high retract forces are suddenly applied to the dipper handle. For example, when the dipper is pulling out of a bank, the crowd motor torque can change from approximately 100% crowd force to approximately 100% retract force, even though required retract force can be at a minimum at the end of the digging cycle. The combination of the applied retract force and the weight of the dipper and materials in the dipper results in high structural loading on the industrial machine. The effects of this structural loading on the industrial machine are a design factor that is ultimately limiting on the performance capabilities of the industrial machine.

The invention described herein provides for the control of an industrial machine such that only a necessary amount of retract force (e.g., a retract motor torque) is applied for a given dipper position. By dynamically controlling the amount of retract force (e.g., throughout a digging operation), the invention can reduce the dynamic structural load and tipping moments on the industrial machine. Additionally, by reducing the loading that the industrial machine experiences as a result of retract force, the payload of the industrial machine can be increased without a corresponding increasing in loading on the industrial machine (i.e., the loading on the industrial machine from the combination of the payload and retract force remains approximately constant, but the reduction in the loading from the retract force allows for an increase in payload). As such, the invention allows for a bigger dipper and a heavier payload of the industrial machine without having to increase the size of other structures or components of the industrial machine (e.g., the gantry, the revolving frame, the roller assembly, etc.) and without increasing the structural loading on the industrial machine.

In one embodiment, the invention provides an industrial machine that includes, among other things, a dipper, a dipper handle, a boom, a crowd motor, a hoist motor, a swing motor, a first sensor, a second sensor, and a controller. The first sensor generates a first signal related to a dipper handle angle and the second sensor generates a second signal related to a hoist rope angle. The first signal and the second signal are received by the controller. The controller determines, based on the first and second signals, a retract torque value. The retract torque value is compared to a retract torque threshold values. If the retract torque value is greater or equal to the threshold value, the retract torque of the crowd motor is set to a maximum value. If the retract torque is less than the threshold value, the retract torque of the crowd motor is set to a default value. In other embodiments, the retract torque of the crowd motor can be set to a value that is determined or calculated as a function of a parameter (e.g., dipper handle angle, rope angle, etc.) of the industrial machine.

In another embodiment, the invention provides an industrial machine that includes a dipper attached to a dipper handle, a crowd motor having a retract torque parameter, a hoist motor operable to apply a force to a hoist rope, a first sensor, a second sensor, and a controller. The first sensor generates a first signal related to a first parameter of the industrial machine, which is received by the controller. The second sensor generates a second signal related to a second parameter of the industrial machine, which is also received by the controller. The controller determines a retract torque limit based on the first signal and the second signal. The controller sets the retract torque parameter of the crowd motor to the retract torque limit, and operates the industrial machine at or below the retract torque parameter.

In another embodiment, the invention provides an industrial machine that includes a dipper attached to a dipper handle, a crowd motor having a retract torque parameter, a hoist motor operable to apply a force to a hoist rope, a first sensor, a second sensor, and a controller. The first sensor generates a first signal related to a first parameter of the industrial machine, which is received by the controller. The second sensor generates a second signal related to a second parameter of the industrial machine, which is also received by the controller. The controller determines a value of the first parameter based on the first signal and compares the value of the first parameter to a first threshold. The controller determines a value of the second parameter based on the second signal and compares the value of the second parameter to a second threshold. Based on the comparison of the value of the first parameter to the first threshold and the comparison of the value of the second parameter to the second threshold, the controller determines a retract torque limit and compares the retract torque limit to a third threshold. The controller sets the retract torque parameter of the crowd motor to a first value if the retract torque limit is greater than or equal to the third threshold. The controller sets the retract torque parameter of the crowd motor to a second value if the retract torque limit is less than the third threshold. The first value is greater than the second value. The controller operates the industrial machine at or below the retract torque parameter.

In another embodiment, the invention provides a method of controlling an actuation device of an industrial machine. The industrial machine includes a sensor and a processor. The method includes the sensor generating a signal related to a parameter of the industrial machine and receiving the signal at the processor. The method also includes determining a retract force limit based on the signal related to the parameter of the industrial machine, setting a crowd parameter of the actuation device to the retract force limit, and operating the industrial machine at or below the retract torque parameter.

Before any embodiments of the invention are explained in detail, it is to be understood that the invention is not limited in its application to the details of the configuration and arrangement of components set forth in the following description or illustrated in the accompanying drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processing units, such as a microprocessor and/or application specific integrated circuits ("ASICs"). As such, it should be noted that a plurality of hardware and software based devices, as well as a plurality of different structural components may be utilized to implement the invention. For example, "servers" and "computing devices" described in the specification can include one or more processing units, one or more computer-readable medium modules, one or more input/output interfaces, and various connections (e.g., a system bus) connecting the components.

Other aspects of the invention will become apparent by consideration of the detailed description and accompanying drawings.

DETAILED DESCRIPTION

The invention described herein relates to systems, methods, devices, and computer readable media associated with the dynamic control of a parameter (e.g., a retract force, a retract torque limit, etc.) of an industrial machine based on a parameter of an industrial machine, such as, for example, a hoist rope angle, a dipper handle angle, a dipper position, etc. The industrial machine, such as an electric rope shovel or similar mining machine, is operable to execute a digging operation to remove a payload (i.e. material) from a bank. As the industrial machine is digging into the bank, the forces on the industrial machine caused by the weight of a payload, structures of the industrial machine, and the relative magnitudes of retract force and hoist force can produce structural loading and a tipping moment (e.g., a center-of-gravity ["CG"] excursion) on the industrial machine. The magnitude of the structural loading can be dependent on, among other things, the payload of the dipper, a retract force or retract force setting, a hoist force or hoist force setting, etc., of the industrial machine. As a result of the structural loading, the industrial machine can experience cyclical structural fatigue and stresses that can adversely affect the operational life of the industrial machine. Structural loading can also limit the performance capabilities of the industrial machine by limiting the level of hoist that can be applied. In order to reduce the structural loading and/or increase performance of the industrial machine, a controller of the industrial machine dynamically limits crowd retract force to a necessary value for different points within the digging cycle. Controlling the operation of the industrial machine in such a manner during a digging operation allows for a reduction in structural loading or an increased payload of the industrial machine without increasing the total structural loading experienced by the industrial machine.

Figure 1:
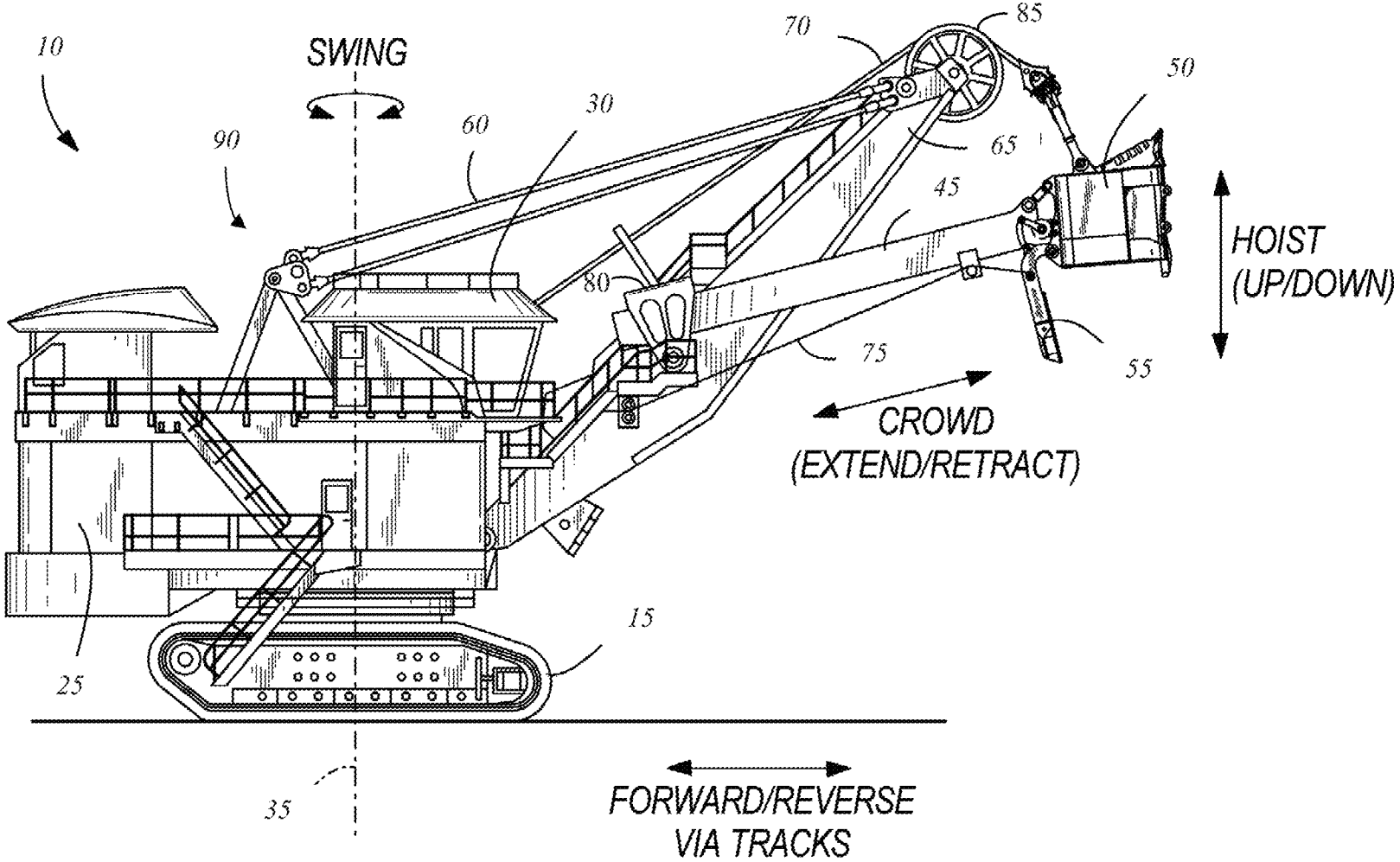
FIG. 1 illustrates an industrial machine according to an embodiment of the invention.

Although the invention described herein can be applied to, performed by, or used in conjunction with a variety of industrial machines (e.g., a rope shovel, a dragline, AC machines, DC machines, hydraulic machines, etc.), embodiments of the invention described herein are described with respect to an electric rope or power shovel, such as the power shovel 10 shown in FIG. 1. The power shovel 10 includes tracks 15 for propelling the shovel 10 forward and backward, and for turning the rope shovel 10 (i.e., by varying the speed and/or direction of left and right tracks relative to each other). The tracks 15 support a base 25 including a cab 30. The base 25 is able to swing or swivel about a swing axis 35, for instance, to move from a digging location to a dumping location. Movement of the tracks 15 is not necessary for the swing motion. The rope shovel 10 further includes a pivotable dipper handle 45 and dipper 50. The dipper 50 includes a door 55 for dumping the contents of the dipper 50.

The rope shovel 10 includes suspension cables 60 coupled between the base 25 and a boom 65 for supporting the boom 65. The rope shovel also includes a wire rope or hoist cable 70 attached to a winch and hoist drum (not shown) within the base 25 for winding the hoist cable 70 to raise and lower the dipper 50, and a crowd cable 75 connected between another winch (not shown) and the dipper door 55. The rope shovel 10 also includes a saddle block 80, a sheave 85, and gantry structures 90. In some embodiments, the rope shovel 10 is a P&H® 4100 series shovel produced by Joy Global Surface Mining.

Figure 2:
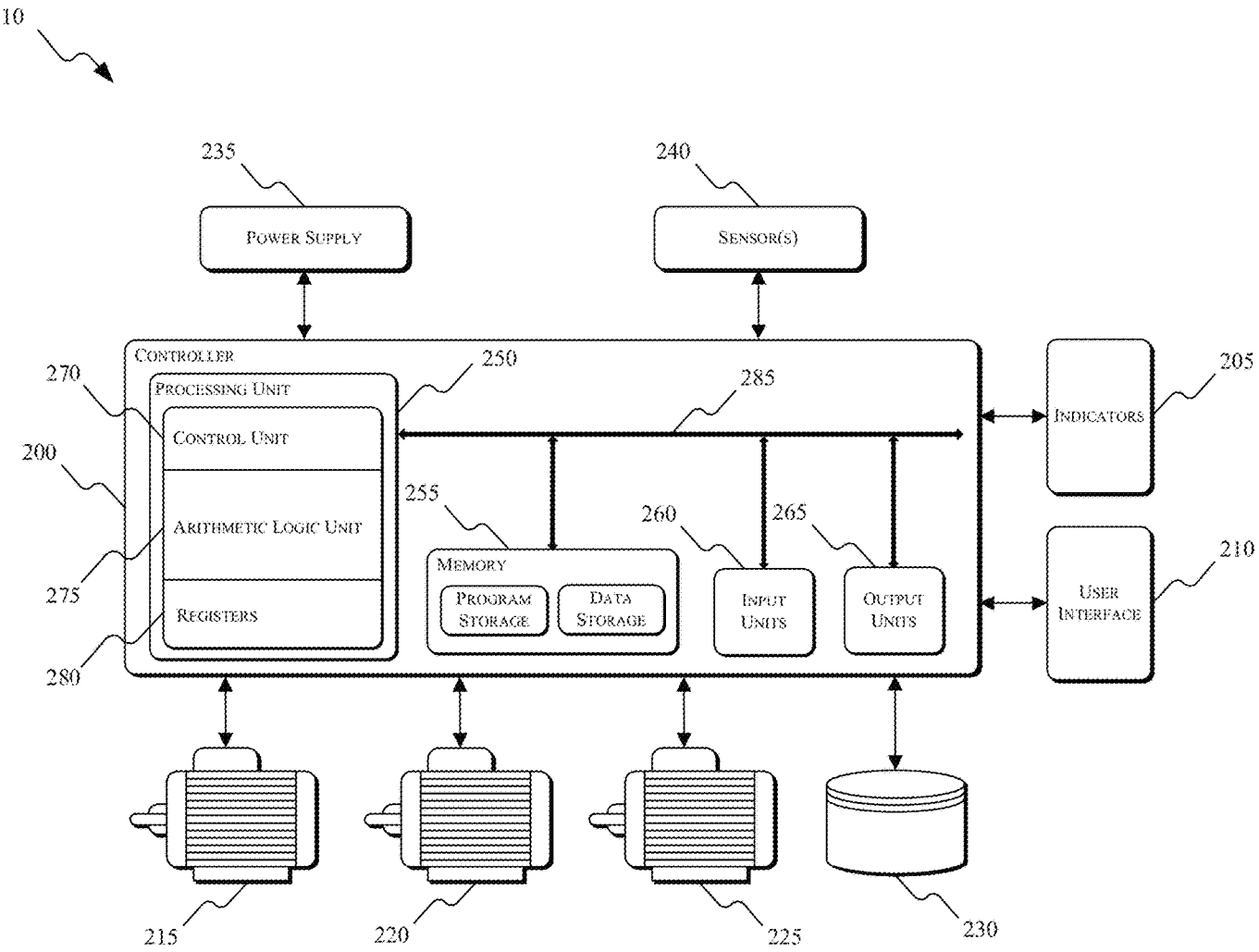
FIG. 2 illustrates a control system of the industrial machine of FIG. 1 according to an embodiment of the invention.

FIG. 2 illustrates a controller 200 associated with the shovel 10 of FIG. 1. The controller 200 is electrically and/or communicatively connected to a variety of modules or components of the shovel 10. For example, the illustrated controller 200 is connected to one or more indicators 205, a user interface module 210, one or more hoist actuation devices (e.g., motors, hydraulic cylinders, etc.) and hoist drives 215, one or more crowd actuation devices (e.g., motors, hydraulic cylinders, etc.) and crowd drives 220, one or more swing actuation devices (e.g., motors, hydraulic cylinders, etc.) and swing drives 225, a data store or database 230, a power supply module 235, and one or more sensors 240. The controller 200 includes combinations of hardware and software that are operable to, among other things, control the operation of the power shovel 10, control the position of the boom 65, the dipper handle 45, the dipper 50, etc., activate the one or more indicators 205 (e.g., a liquid crystal display ["LCD"]), monitor the operation of the shovel 10, etc. The one or more sensors 240 include, among other things, a loadpin strain gauge, one or more inclinometers, gantry pins, one or more motor field modules, one or more resolvers, etc. In some embodiments, a crowd drive other than a crowd motor drive can be used (e.g., a crowd drive for a single legged handle, a stick, a hydraulic cylinder, etc.).

In some embodiments, the controller 200 includes a plurality of electrical and electronic components that provide power, operational control, and protection to the components and modules within the controller 200 and/or shovel 10. For example, the controller 200 includes, among other things, a processing unit 250 (e.g., a microprocessor, a microcontroller, or another suitable programmable device), a memory 255, input units 260, and output units 265. The processing unit 250 includes, among other things, a control unit 270, an arithmetic logic unit ("ALU") 275, and a plurality of registers 280 (shown as a group of registers in FIG. 2), and is implemented using a known computer architecture, such as a modified Harvard architecture, a von Neumann architecture, etc. The processing unit 250, the memory 255, the input units 260, and the output units 265, as well as the various modules connected to the controller 200 are connected by one or more control and/or data buses (e.g., common bus 285). The control and/or data buses are shown generally in FIG. 2 for illustrative purposes. The use of one or more control and/or data buses for the interconnection between and communication among the various modules and components would be known to a person skilled in the art in view of the invention described herein. In some embodiments, the controller 200 is implemented partially or entirely on a semiconductor (e.g., a field-programmable gate array ["FPGA"] semiconductor) chip, such as a chip developed through a register transfer level ("RTL") design process.

The memory 255 includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The processing unit 250 is connected to the memory 255 and executes software instructions that are capable of being stored in a RAM of the memory 255 (e.g., during execution), a ROM of the memory 255 (e.g., on a generally permanent basis), or another non-transitory computer readable medium such as another memory or a disc. Software included in the implementation of the shovel 10 can be stored in the memory 255 of the controller 200. The software includes, for example, firmware, one or more applications, program data, filters, rules, one or more program modules, and other executable instructions. The controller 200 is configured to retrieve from memory and execute, among other things, instructions related to the control processes and methods described herein. In other constructions, the controller 200 includes additional, fewer, or different components.

The power supply module 235 supplies a nominal AC or DC voltage to the controller 200 or other components or modules of the shovel 10. The power supply module 235 is powered by, for example, a power source having nominal line voltages between 100V and 240V AC and frequencies of approximately 50-60 Hz. The power supply module 235 is also configured to supply lower voltages to operate circuits and components within the controller 200 or shovel 10. In other constructions, the controller 200 or other components and modules within the shovel 10 are powered by one or more batteries or battery packs, or another grid-independent power source (e.g., a generator, a solar panel, etc.).

The user interface module 210 is used to control or monitor the power shovel 10. For example, the user interface module 210 is operably coupled to the controller 200 to control the position of the dipper 50, the position of the boom 65, the position of the dipper handle 45, etc. The user interface module 210 includes a combination of digital and analog input or output devices required to achieve a desired level of control and monitoring for the shovel 10. For example, the user interface module 210 includes a display (e.g., a primary display, a secondary display, etc.) and input devices such as touch-screen displays, a plurality of knobs, dials, switches, buttons, etc. The display is, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, etc. The user interface module 210 can also be configured to display conditions or data associated with the power shovel 10 in real-time or substantially real-time. For example, the user interface module 210 is configured to display measured electrical characteristics of the power shovel 10, the status of the power shovel 10, the position of the dipper 50, the position of the dipper handle 45, etc. In some implementations, the user interface module 210 is controlled in conjunction with the one or more indicators 205 (e.g., LEDs, speakers, etc.) to provide visual or auditory indications of the status or conditions of the power shovel 10.

Figure 3:
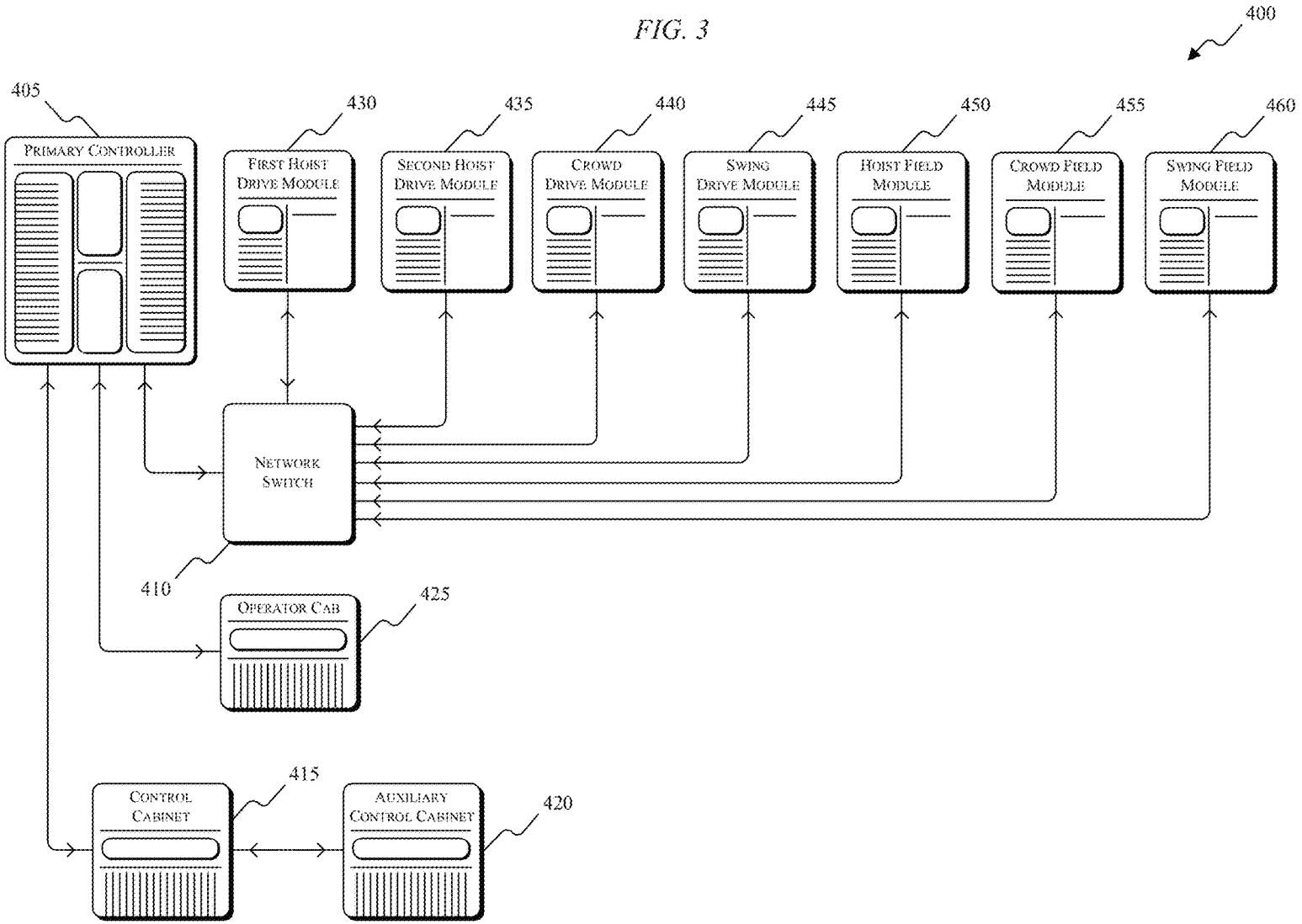
FIG. 3 illustrates a control system of the industrial machine of FIG. 1 according to another embodiment of the invention.

FIG. 3 illustrates a more detailed control system 400 for the power shovel 10. For example, the power shovel 10 includes a primary controller 405, a network switch 410, a control cabinet 415, an auxiliary control cabinet 420, an operator cab 425, a first hoist drive module 430, a second hoist drive module 435, a crowd drive module 440, a swing drive module 445, a hoist field module 450, a crowd field module 455, and a swing field module 460. The various components of the control system 400 are connected by and communicate through, for example, a fiber-optic communication system utilizing one or more network protocols for industrial automation, such as process field bus ("PROFIBUS"), Ethernet, ControlNet, Foundation Fieldbus, INTERBUS, controller-area network ("CAN") bus, etc. The control system 400 can include the components and modules described above with respect to FIG. 2. For example, the one or more hoist actuation devices and/or drives 215 correspond to first and second hoist drive modules 430 and 435, the one or more crowd actuation devices and/or drives 220 correspond to the crowd drive module 440, and the one or more swing actuation devices and/or drives 225 correspond to the swing drive module 445. The user interface 210 and the indicators 205 can be included in the operator cab 425, etc. A strain gauge, an inclinometer, gantry pins, resolvers, etc., can provide electrical signals to the primary controller 405, the controller cabinet 415, the auxiliary cabinet 420, etc.

The first hoist drive module 430, the second hoist drive module 435, the crowd drive module 440, and the swing drive module 445 are configured to receive control signals from, for example, the primary controller 405 to control hoisting, crowding, and swinging operations of the shovel 10. The control signals are associated with drive signals for hoist, crowd, and swing actuation devices 215, 220, and 225 of the shovel 10. As the drive signals are applied to the actuation devices 215, 220, and 225, the outputs (e.g., electrical and mechanical outputs) of the actuation devices are monitored and fed back to the primary controller 405 (e.g., via the field modules 450-460). The outputs of the actuation devices include, for example, motor position, motor speed, motor torque, motor power, motor current, hydraulic pressure, hydraulic force, etc. Based on these and other signals associated with the shovel 10, the primary controller 405 is configured to determine or calculate one or more operational states or positions of the shovel 10 or its components. In some embodiments, the primary controller 405 determines a dipper position, a dipper handle angle or position, a hoist rope wrap angle, a hoist motor rotations per minute ("RPM"), a number of dead wraps, a crowd motor RPM, a dipper speed, a dipper acceleration, a CG excursion (e.g., with respect to axis 35), a tipping moment, total gantry load (e.g., total gantry structural loading), etc.

Figure 4:
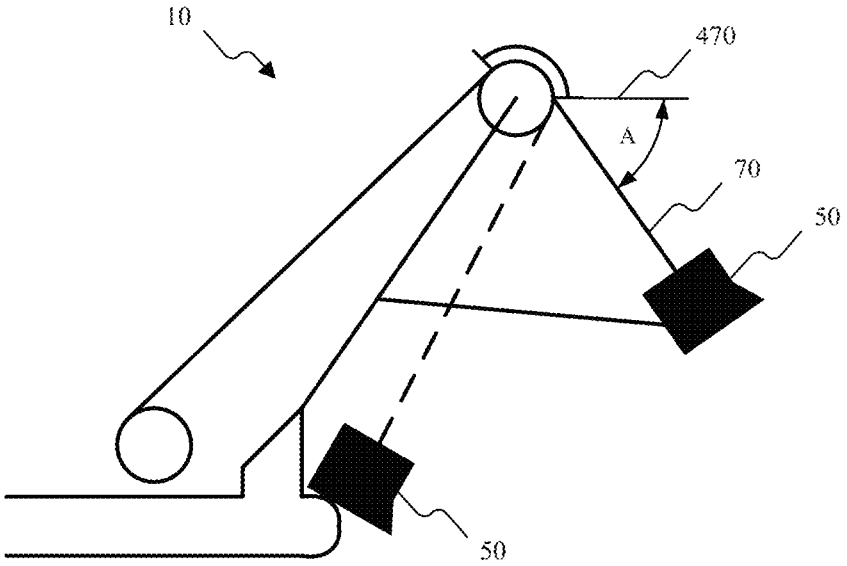
FIG. 4 illustrates a hoist rope angle of the industrial machine of FIG. 1.
Figure 5:
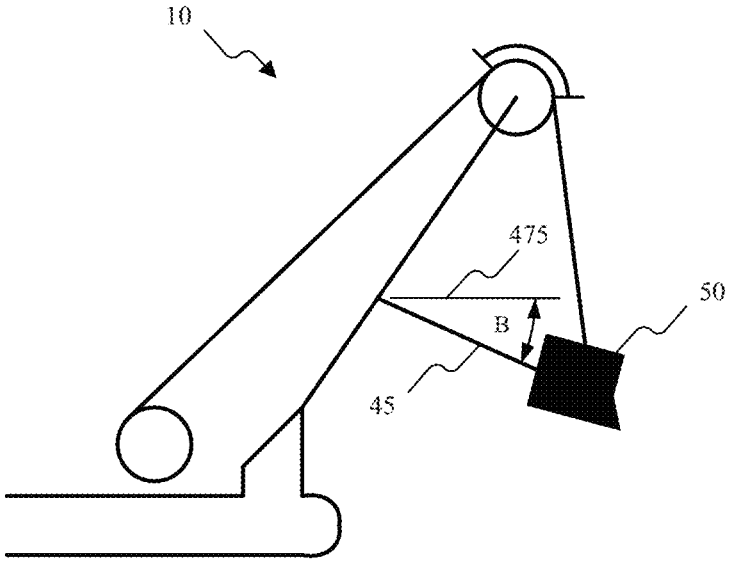
FIG. 5 illustrates a dipper handle angle of the industrial machine of FIG. 1.

The controller 200 and/or the control system 400 of the shovel 10 described above are used to control an operational parameter (e.g., retract force, retract torque, etc.) of the industrial machine 10 based on, for example, component (e.g., dipper, digging attachment, etc.) position, dipper handle angle, hoist rope angle, or another parameter determined or received by the controller 200 or the system 400 described above. FIG. 4 illustrates a hoist rope angle that can be determined by the controller 200. As shown in FIG. 4, the dipper 50 can be located in various positions throughout a digging cycle. The hoist rope angle is illustrated as a negative angle between a horizontal axis 470 and the hoist or wire rope 70. The hoist rope angle can be determined using, for example, one or more resolvers, a kinematic model of the industrial machine, a dipper location, a hoist rope length, etc. FIG. 5 illustrates a dipper handle angle that can be determined by the controller 200. The dipper handle angle is illustrated as the negative angle between a second horizontal axis 475 and the dipper handle 45. The hoist rope angle can be determined using, for example, one or more resolvers, a kinematic model of the industrial machine, an inclinometer, a dipper location, a hoist rope length, etc. Component position can be determined using, for example, one or more resolvers, a kinematic model of the industrial machine, an inclinometer, a hoist rope length, etc.

The processes 500, 600, and 700 are associated with and described herein with respect to a digging operation and forces (e.g., crowd forces, etc.) applied during the digging operation. Various steps described herein with respect to the processes 500, 600, and 700 are capable of being executed simultaneously, in parallel, or in an order that differs from the illustrated serial manner of execution. The processes 500, 600, and 700 may also be capable of being executed using fewer steps than are shown in the illustrated embodiment. For example, in some embodiments, one or more functions, formulas, or algorithms can be used to calculate a maximum required retract force, and the maximum required retract force is determined or calculated by the controller 200 approximately every 40-100 ms. In other embodiments, the controller can determine a retract torque limit for the industrial machine at different rates (e.g., less than every 40 ms, greater than every 100 ms, etc.) depending on a clock speed of the processor in the controller.

Figure 6:
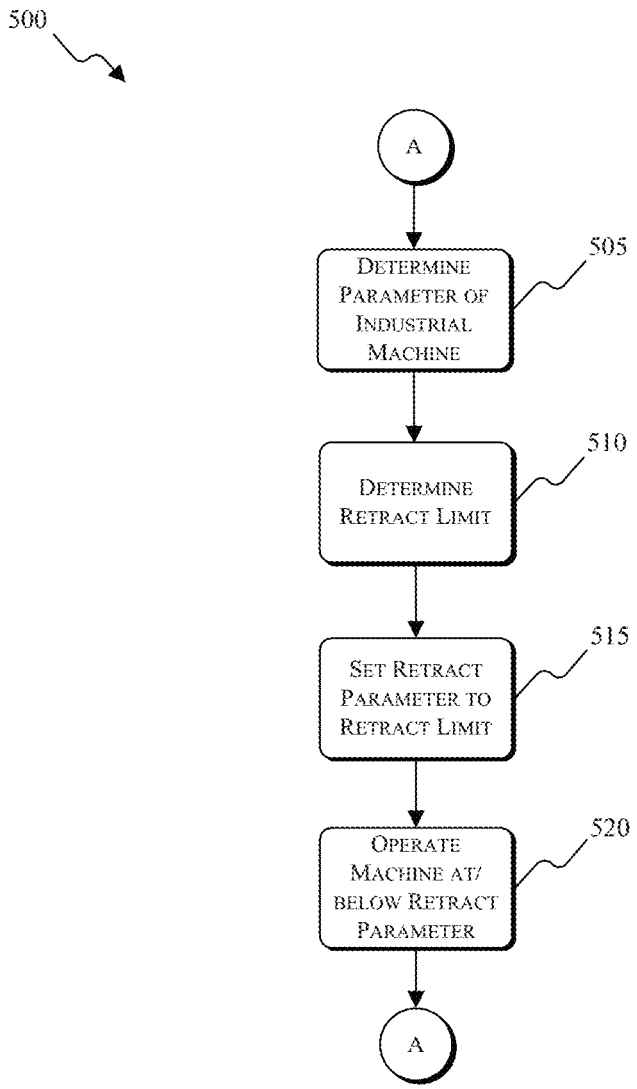
FIG. 6 is a process for setting a retract limit of an industrial machine according to an embodiment of the invention.

The process 500 shown in FIG. 6 begins with the controller 200 determining a parameter of the industrial machine (step 505). The parameter of the industrial machine can be, for example, component position, a dipper handle angle, a hoist rope angle, or another parameter determined or received by the controller 200 or the system 400 described above. Based on the value of the parameter of the industrial machine, the controller 200 determines a crowd parameter that limits maximum retract force such as a retract parameter, a retract force limit, ramp rate, or a retract torque limit for the industrial machine (step 510). As an illustrative example, the processes 500, 600 (below), and 700 (below) will be described herein with respect to the setting of a retract force limit. In other embodiments, any of the additional or different parameters described above as being determined or received by the controller 200 or control system 400 can similarly be used to set the crowd parameter.

The retract force limit can be set, for example, as a function (e.g., a linear function, a non-linear function, a quadratic function, a cubic function, an exponential function, a hyperbolic function, a power function, etc.) of dipper position, the dipper handle angle, the hoist rope angle, both the dipper handle angle and the hoist rope angle, or another parameter determined or received by the controller 200 or the system 400 described above (e.g., retract force limit can be set as a linear function, quadratic function, etc. of tipping moment or CG excursion). Additionally or alternatively, one or more predetermined or calculated values for the retract force limit can be set for different portions of a digging cycle. In each instance, the retract force limit is set to a value that corresponds to a maximum amount of retract force that is required for a given portion of a digging cycle. In some embodiments, less retract force is required later in the digging cycle than is required earlier in the digging cycle. In some embodiments, more retract force is required when the dipper is located closer in proximity to the industrial machine (e.g., the base 25) than when the dipper is positioned away from the industrial machine (e.g., when dipper handle is fully extended).

The values that the retract force limit can be set to range, for example, from a minimum value (e.g., 0% retract force) to a maximum value (e.g., 100% retract force). Using conventional control techniques, a default value for retract force may be set to 85%-100% throughout an entire digging operation. By controlling the retract force limit to many values (e.g., between 0% and 100%), only the retract force that is required for a given dipper position is available to the industrial machine, which eliminates problems associated with too much or too little retract force. For example, by controlling the retract force limit of the industrial machine, the industrial machine will pick up the handle and the dipper consistently with each digging operation and overcoming the potential issue of having too little retract force that is unable to pick up the handle and dipper or too much retract force that can cause damage to shovel components.

At step 515, the retract parameter of the crowd actuation device is set to the retract force limit that was determined at step 510. Following the setting of the retract parameter to the retract force limit, the industrial machine is operated with retract force at or below (i.e., less than or equal to) the retract parameter (step 520). The process 500 then returns to step 505 where the parameter of the industrial machine is again determined. As indicated above, in some embodiments, the retract force limit can be determined approximately every 40-100 ms. In such embodiments, the parameter of the industrial machine can be determined and the retract force limit can be set to a calculated value every approximately 40-100 ms. In other embodiments, the controller can determine a retract force limit for the industrial machine at different rates (e.g., less than every 40 ms, greater than every 100 ms, etc.) depending on a clock speed of the processor in the controller.

Figure 7:
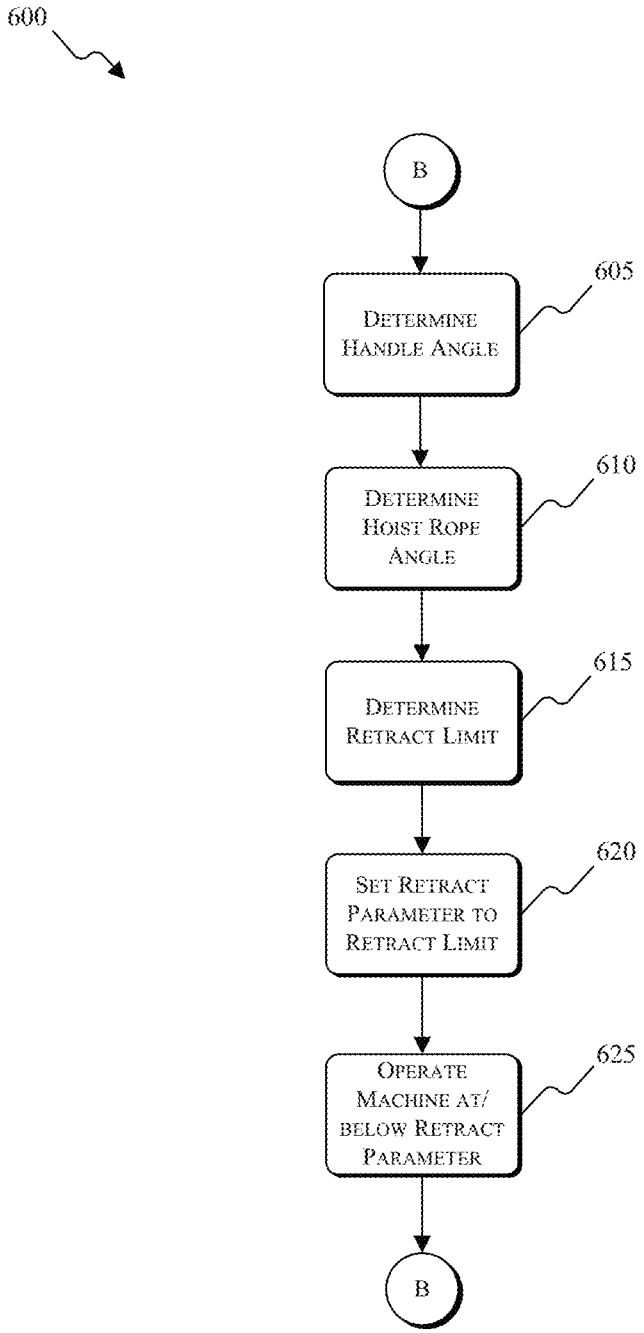
FIG. 7 is a process for setting a retract limit of an industrial machine according to another embodiment of the invention.

The process 600 shown in FIG. 7 begins with the controller 200 determining a dipper handle angle of the dipper handle of the industrial machine (step 605). The controller 200 then determines a hoist rope angle of the hoist rope of the industrial machine (step 610). Based on the value of the dipper handle angle and the value of the hoist rope angle, the controller 200 determines a retract force limit for the industrial machine (step 615). At step 620, the retract parameter of the crowd actuation device is set to the retract force limit that was determined at step 615. Following the setting of the retract parameter to the retract force limit, the industrial machine is operated with retract force at or below (i.e., less than or equal to) the retract parameter (step 625). The process 600 then returns to step 605 where the parameter of the industrial machine is again determined. As indicated above, in some embodiments, the retract force limit can be determined approximately every 40-100 ms. In such embodiments, the dipper handle angle and the hoist rope angle can be determined and the retract force limit can take on a calculated value every approximately 40-100 ms. In other embodiments, the controller can determine a retract force limit for the industrial machine at different rates (e.g., less than every 40 ms, greater than every 100 ms, etc.) depending on a clock speed of the processor in the controller.

Figure 8:
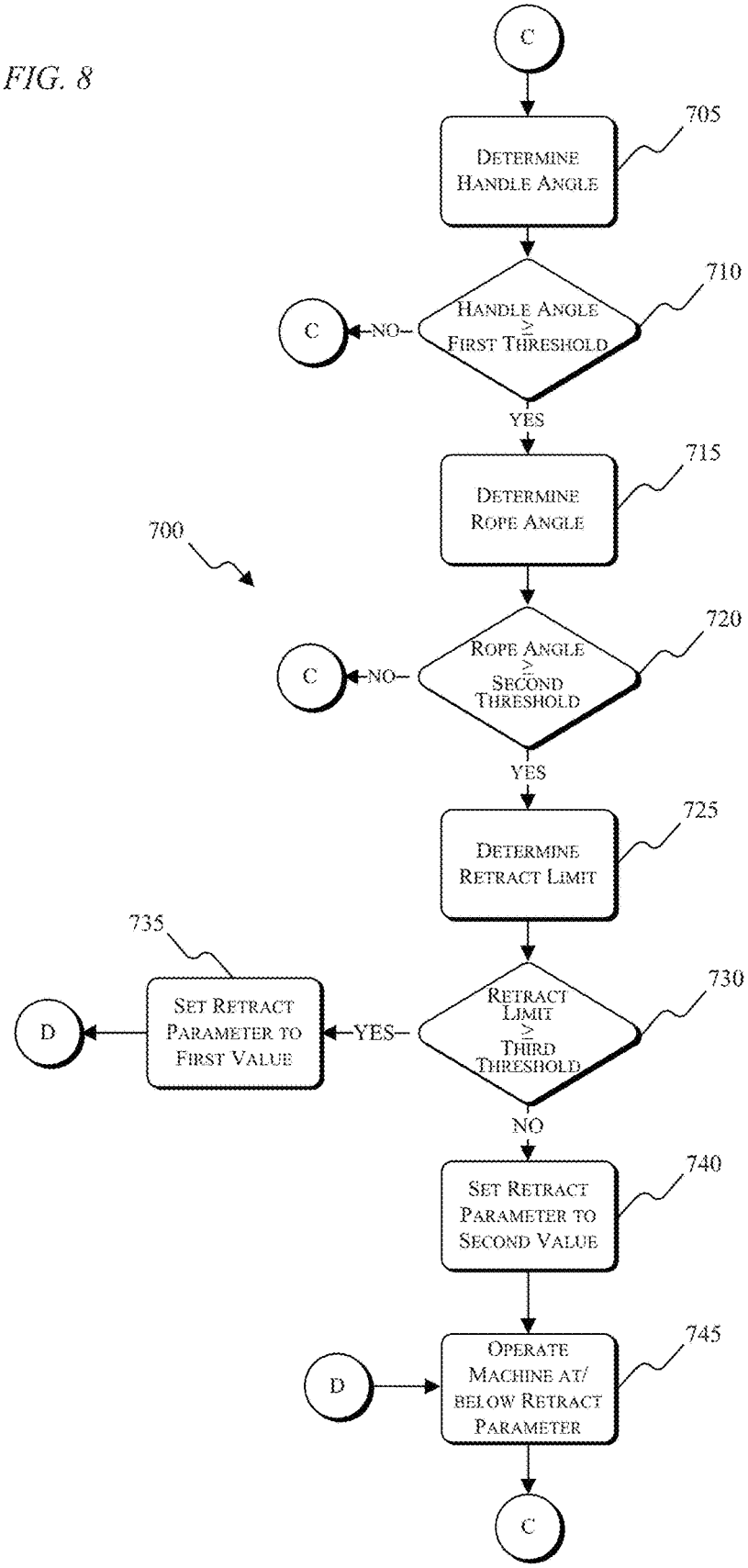
FIG. 8 is a process for setting a retract limit of an industrial machine according to another embodiment of the invention.

The process 700 shown in FIG. 8 begins with the controller 200 determining a dipper handle angle of the dipper handle of the industrial machine (step 705). If, at step 710, the dipper handle angle is greater than or equal to a first threshold value or corresponds to a first predetermined range of values (e.g., −90°-0°), the controller 200 determines a hoist rope angle of the hoist rope of the industrial machine (step 715). If, at step 710, the dipper handle angle is less than the first threshold value or is outside of the first predetermined range, the process 700 returns to step 705 where the dipper handle angle is again determined. Following step 715, the rope angle is greater than or equal to a second threshold value or corresponds to a second predetermined range of values (e.g., 0°-90°), the controller 200 determines retract force limit (step 725). If, at step 720, the rope angle is less than the second threshold value or is outside of the second predetermined range, the process 700 returns to step 705 where the dipper handle angle is again determined.

Based on the value of the dipper handle angle and the value of the hoist rope angle, the controller 200 determines the retract force limit for the industrial machine (step 725). At step 730, the retract force limit is compared to a third threshold value. If, at step 730, the retract limit is greater than or equal to the third threshold value, the retract parameter of the crowd actuation device is set to a maximum value (e.g., 100% crowd retract) (step 735). If, at step 730, the retract limit is less than the first threshold, the retract parameter is set to the default retract force value (e.g., 85% crowd retract) (step 740). Following steps 735 and 740, the industrial machine is operated with retract force at or below (i.e., less than or equal to) the retract parameter (step 745). The process 700 returns to step 705 where the dipper handle angle is again determined. As indicated above, in some embodiments, the retract force limit can be determined approximately every 40-100 ms. In such embodiments, the dipper handle angle and the hoist rope angle can be determined and the retract force limit can take on a calculated value every approximately 40-100 ms. In other embodiments, the controller can determine a retract force limit for the industrial machine at different rates (e.g., less than every 40 ms, greater than every 100 ms, etc.) depending on a clock speed of the processor in the controller.

Additionally or alternatively, in some embodiments, the calculation or setting of a retract force limit can be based on dipper position, cycle status values, a hoist force (e.g., a hoist motor torque or a hoist bail pull), etc. In some embodiments, the retract force limit can also be set based on a determined tipping moment (e.g., a forward tipping moment) of the industrial machine, or a parameter that is indicative of a tipping moment of the industrial machine (e.g., a signal from a sensor such as a loadpin [e.g., gantry load pin], a strain gauge in the gantry structures 90, the base 25, the boom 65, suspension ropes 60, etc.).

Figure 9:
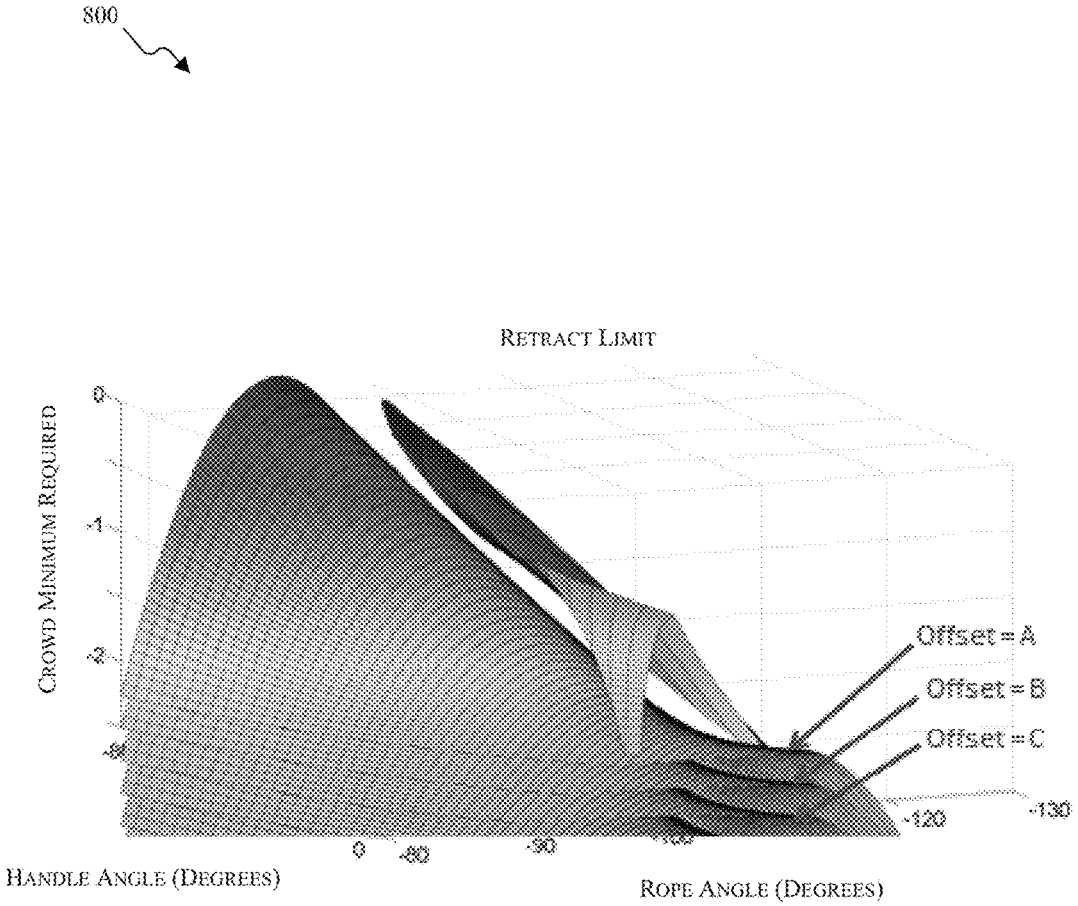
FIG. 9 is a graphical representation of retract torque limits of an industrial machine according to an embodiment of the invention.
Figure 10:
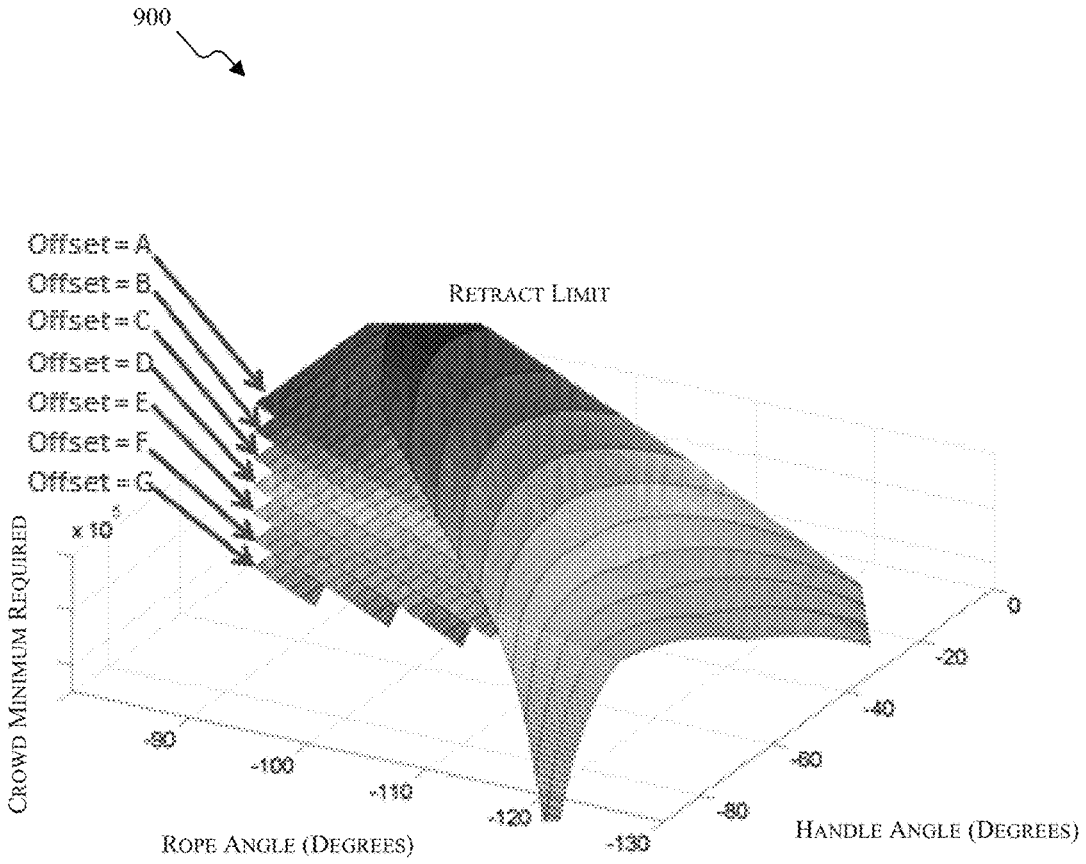
FIG. 10 is a graphical representation of retract torque limits of an industrial machine according to another embodiment of the invention.

FIGS. 9 and 10 illustrate graphs 800 and 900 of crowd retract force limit values as a function of dipper handle angle and hoist rope angle. As described above, in some embodiments, the retract force limit values can be set based on one of the dipper handle angle or the hoist rope angle. If the retract force limit value is set based on only one parameter of the industrial machine, a two dimensional graph of retract force limit values with respect to that parameter can be produced (not shown). The three dimensional graphs of FIGS. 9 and 10 are shown for illustrative purposes. In FIGS. 9 and 10, the retract force limit required by the industrial machine is a minimum (illustrated in red) when the dipper is extended away from the industrial machine (e.g., dipper handle angle approximately 0°) and the dipper is raised to its highest point (e.g., hoist rope angle approximately 90°). The retract force limit required by the industrial machine is a maximum (illustrated as blue/green) when the dipper handle is approximately vertical (e.g., dipper handle angle approximately −90°).

Additionally, offset values for the retract force limits can be set. In some embodiments, the offset values for the retract force limits are a product of the specifications of the crowd motor. The offset values can be used to increase or decrease maximum and minimum values for retract force limit. For example, in some embodiments, the determined retract limit that is required can correspond to an amount of retract force that is required to hold a payload in the air. Additional retract force is then used to move the payload. This additional retract force can be added by the illustrated force offset values.

Thus, the invention provides, among other things, systems, methods, devices, and computer readable media for setting a retract parameter such as a force limit value for an industrial machine based on a parameter of the industrial machine. Various features and advantages of the invention are set forth in the following claims.

What is claimed is:

1. A controller comprising:

a memory; and an electronic processor electrically connected to the memory, the electronic processor configured to receive a first signal related to a first parameter, receive a second signal related to a second parameter, determine a retract torque limit based on the first signal and the second signal, set a retract torque parameter of a crowd motor to the retract torque limit that has been determined, and operate the crowd motor at or below the retract torque parameter.

2. The controller of claim 1, wherein the retract torque limit is determined as a function of the first parameter and the second parameter.

3. The controller of claim 2, wherein the function is selected from a group consisting of a linear function, a non-linear function, a quadratic function, a cubic function, an exponential function, a hyperbolic function, and a power function.

4. The controller of claim 2, wherein the first parameter is an angle of a dipper handle and the second parameter is an angle of a hoist rope.

5. The controller of claim 1, wherein the retract torque limit corresponds to a maximum amount of retract torque that is required for a given portion of a digging cycle of an industrial machine.

6. The controller of claim 5, wherein the retract torque limit early in the digging cycle has a greater value than the retract torque limit late in the digging cycle.

7. The controller of claim 5, wherein the retract torque limit is determined as a function of a tipping moment of the industrial machine.

8. A controller comprising:

a memory; and an electronic processor electrically connected to the memory, the electronic processor configured to receive a first signal related to a first parameter, receive a second signal related to a second parameter, determine a value of the first parameter based on the first signal, compare the value of the first parameter to a first threshold, determine a value of the second parameter based on the second signal, compare the value of the second parameter to a second threshold, determine a retract torque limit based on the comparison of the value of the first parameter to the first threshold and the comparison of the value of the second parameter to the second threshold, compare the retract torque limit to a third threshold, set a retract torque parameter of a crowd motor to a first value if the retract torque limit is greater than or equal to the third threshold, set the retract torque parameter of the crowd motor to a second value if the retract torque limit is less than the third threshold, the first value is greater than the second value, and operate the crowd motor at or below the retract torque parameter.

9. The controller of claim 8, wherein the retract torque limit is determined as a function of the value of the first parameter and the value of the second parameter.

10. The controller of claim 9, wherein the function is selected from a group consisting of a linear function, a non-linear function, a quadratic function, a cubic function, an exponential function, a hyperbolic function, and a power function.

11. The controller of claim 8, wherein the first parameter is an angle of a dipper handle and the second parameter is an angle of a hoist rope.

12. The controller of claim 8, wherein the retract torque limit corresponds to a maximum amount of retract torque that is required for a given portion of a digging cycle of an industrial machine.

13. The controller of claim 12, wherein the retract torque limit early in the digging cycle has a greater value than the retract torque limit late in the digging cycle.

14. The controller of claim 12, wherein the retract torque limit is determined as a function of a tipping moment of the industrial machine.

15. The controller of claim 8, wherein the first threshold is related to a predetermined range of dipper handle angle values.

16. The controller of claim 8, wherein the second threshold is related to a predetermined range of hoist rope angle values.

17. A controller comprising:

a memory; and an electronic processor electrically connected to the memory, the electronic processor configured to receive a first signal related to a dipper handle angle, receive a second signal related to a hoist rope angle, determine a retract torque value based on the first signal and the second signal, compare the retract torque value to a retract torque threshold value, and responsive to determining the retract torque value is greater or equal to the retract torque threshold value, set a retract torque of a crowd motor to a maximum value.

18. A controller comprising:

a memory; and an electronic processor electrically connected to the memory, the electronic processor configured to receive a first signal related to a dipper handle angle, receive a second signal related to a hoist rope angle, determine a retract torque value based on the first signal and the second signal, compare the retract torque value to a retract torque threshold value, and responsive to determining the retract torque value is less than the retract torque threshold value, set a retract torque of a crowd motor to a default value.

19. A controller comprising:

a memory; and an electronic processor electrically connected to the memory, the electronic processor configured to receive a first signal related to a dipper handle angle, receive a second signal related to a hoist rope angle, determine a retract torque value based on the first signal and the second signal, compare the retract torque value to a retract torque threshold value, and responsive to determining the retract torque value is less than the retract torque threshold value, set a retract torque of a crowd motor to a value that is determined as a function of a parameter of an industrial machine.

20. The controller of claim 19, wherein the parameter of the industrial machine includes the dipper handle angle and the hoist rope angle.

* * * * *